United States Patent [19]

Henderson et al.

[11] 4,140,299

[45] Feb. 20, 1979

[54] MIXING LIQUIDS

[75] Inventors: Robert A. Henderson; Arthur Perelman, both of Harrogate, England

[73] Assignee: Imperial Chemical Industries Limited, London, England

[21] Appl. No.: 586,913

[22] Filed: Jun. 16, 1975

[30] Foreign Application Priority Data

Jul. 4, 1974 [GB] United Kingdom ..... 29684/74

[51] Int. Cl.[2] ..... B01F 7/24

[52] U.S. Cl. ..... 366/177; 366/168; 366/318

[58] Field of Search ..... 259/7, 8, 23, 24

[56] References Cited

U.S. PATENT DOCUMENTS

| | | | |
|---|---|---|---|
| 2,857,144 | 10/1958 | Gurley et al. | 259/7 |
| 3,362,919 | 1/1968 | Rood | 259/7 |
| 3,741,441 | 6/1973 | Eberle | 259/7 |
| 3,831,907 | 8/1974 | Claes | 259/7 |

*Primary Examiner*—Richard E. Aegerter
*Assistant Examiner*—L. Footland
*Attorney, Agent, or Firm*—Cushman, Darby & Cushman

[57] ABSTRACT

Mixing of liquids by passing through space delineated by body of revolution and surrounding co-operating casing in relative rotation, the co-operating surface of rotating part having plurality of grooves at angle less than 80° to its axis and one liquid being fed to grooved surface at point distance by less than distance between body and casing, and the liquids being immediately thereafter fed through zone providing high grade dispersive mixing.

25 Claims, 2 Drawing Figures

MIXING LIQUIDS

The present invention relates to the mixing of liquids.

According to the present invention we provide a process for the mixing of a first liquid in minor amount with a second liquid in major amount, wherein the second liquid is continuously forcibly fed in an axial direction through at least one space delineated by a body of revolution and a surrounding co-operating casing, the body and the casing being in relative rotation, the co-operating surface of the body or of the casing which is rotated having in it a plurality of grooves at an angle less than 80° to its axis, the first liquid being continuously forcibly fed into the space at a point distant from the surface bearing the plurality of grooves by less than the distance between the body and the casing and the two liquids are immediately thereafter fed through a zone wherein high grade dispersive mixing is effected whereby fine dispersion of the first liquid in the second liquid is completed.

Preferably the body of revolution is cylindrical. Preferably the inner surface of the surrounding co-operating casing is cylindrical.

Preferably the distance apart of the plurality of grooves is at least equal to the width of a groove and does not exceed 10 times the width of a groove. Preferably the distance apart is from 2 to 5 times the width of a groove. Preferably the floor of each groove is rounded.

Preferably the distance between the body and the casing is at least a sixteenth of an inch but does not exceed half an inch.

Preferably the point at which the first liquid is fed into the chamber is distant from the surface bearing the plurality of grooves by no more than 0.030 inches (0.76 mm.) and no less than 0.005 inches (0.13 mm.). More preferably it is distant by from 0.010 inches (0.25 mm.) to 0.020 inches (0.5 mm.). Preferably this point should be just downstream of the end of the plurality of grooves nearer to the inlet.

Preferably the plurality of grooves each have the same spiral angle. Preferably the plurality of grooves spiral in such sense with respect to the sense of rotation that they tend to impose on the liquids a flow opposed to that of the forcible feed of the second liquid.

According to the present invention we also provide an apparatus for mixing liquids comprising a body of revolution and a surrounding co-operating casing, the body and the casing being adapted for relative rotation, the co-operating surface of the body or of the casing which is adapted for rotation having a plurality of grooves at an angle less than 80° to its axis, a feed orifice for a first liquid terminating at a point distant from the surface having a plurality of grooves by less than the distance between the body and the casing, associated means for forcing a second liquid from an inlet through the gap between the body and the casing and associated means for receiving the liquids immediately after passing through the gap, said means being a mixer adapted to provide high grade dispersive mixing adequate to complete dispersion.

The process of our invention is particularly effective for use in mixing immiscible liquids, one in major amount possessing high viscosity and the other in minor amount possessing a low viscosity, in a continuous manner. The process of our invention is particularly advantageous in the case wherein the liquid in major amount has at least ten times the viscosity of that of the liquid in minor amount, and even more advantageous in the case wherein the liquid in major amount has at least 1000 times the viscosity of that of the liquid in minor amount.

The forcible feeding of the first and second liquids may be by any known method, for example gear pumps, piston pumps and peristaltic pumps.

The passage of the liquid through the gap between the body of revolution and the surrounding co-operating casing results in a good distribution of the liquid in minor amount in the liquid in major amount. It is believed that the passage thereafter of the liquid through the high grade dispersive mixer has the function of further reducing the size of droplets of the liquid in minor amount with production of a uniform, fine dispersion. The zone wherein high grade dispersive mixing is effected may be any conventional means adequate for this purpose and may comprise an extension of the body of revolution co-operating with an extension of the surrounding casing, the co-operation between the extensions being such as to provide the requisite degree of shear to ensure the distributive mixing. The co-operating surface of the extension to the body of revolution or the extension to the casing, whichever is rotated, may, for example, be in the form of a screw forming a close fit with the co-operating extension. Advantageously the screw may may be so formed with relation to the sense of rotation that it tends to impel the liquids in the direction opposed to that of the forced feeding of the second liquid.

In the ambit of our invention, we include the provision of more than one feed orifice for the first liquid.

In the ambit of our invention we also include the provision of more than one body of revolution — surrounding co-operating casing pairs within one chamber operating in parallel. Moreover, a co-operating casing having a body of revolution within it may itself serve as a body of revolution in respect of a further co-operating casing, and so on.

Specific embodiments of the present invention will now be described with particular reference to FIGS. 1 and 2 wherein.

Figure 1:
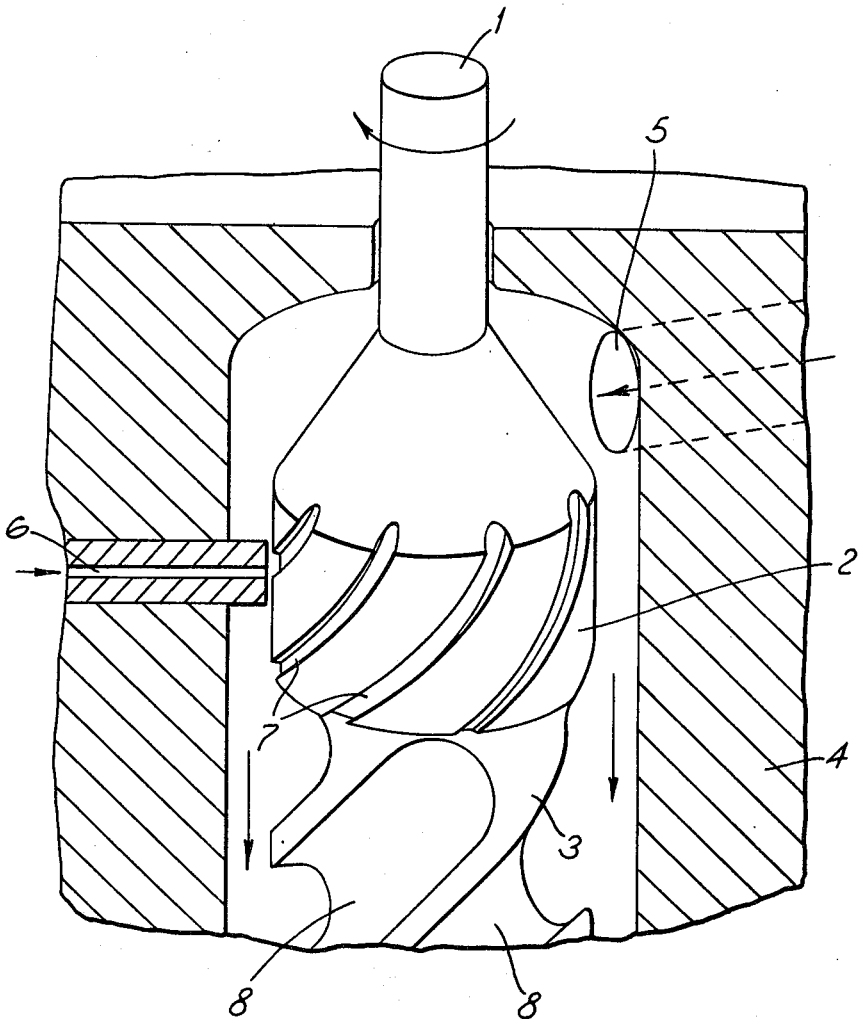
FIG. 1 shows an apparatus for mixing liquids according to the present invention with a single pair of body of revolution and surrounding co-operating casing.

Referring to FIG. 1, a rotor (1), comprising a body of revolution (2) and a screw (3), is adapted for rotation within a surrounding co-operating casing (4), having inlet for second liquid (5) and inlet for third (6), the latter terminating at a distance of 0.010 inches (0.25 mm.) from the body of revolution (2). The surface of the body of revolution (2) is distant by 0.1 inches (2.5 mm.) from the co-operating surface of the casing (4), and has a diameter of 2.25 inches. The surface of the body of revolution (2) has 12 grooves (7) of width 0.1 inches and depth 0.08 inches (2 mm.) at an angle of 45° to the axis of rotation. The screw (3) comprises a cylinder of length 6 inches and diameter 2.2 inches (55.9 mm.) in the surface of which are cut 6 spiral channels grooves (8) of semi-elliptical cross section of width $\frac{3}{4}$ inch (19 mm.) and maximum depth 0.5 inch (12.7 mm.) at an angle of 55° to the axis of rotation. In addition, the screw has 5 axially disposed grooves (not shown in the Figure) in the screw flights $\frac{3}{8}$ inch (9.5 mm.) in width and to the full depth of the grooves.

In operation, the rotor (1) was rotated at a speed of rotation of 120 rotations per minute in the sense tending to drive the liquid towards the inlet (5) while poly(ethylene terephthalate) of melt viscosity at the temperature of operation (280° C.) of 2,500 poise at a flow rate of 60 pounds (27.2 kg.) per hour was fed in through the inlet (5) and ethoxylated hydrogenated castor oil of viscosity (at 280° C.) of 30 centipoises was fed through the inlet (6) at a rate of 3 pounds (1.36 kg.) per hour. The liquid issuing from the exit of the apparatus (not shown) was a good dispersion of ethoxylated hydrogenated castor oil droplets in poly(ethylene terephthalate).

Figure 2:
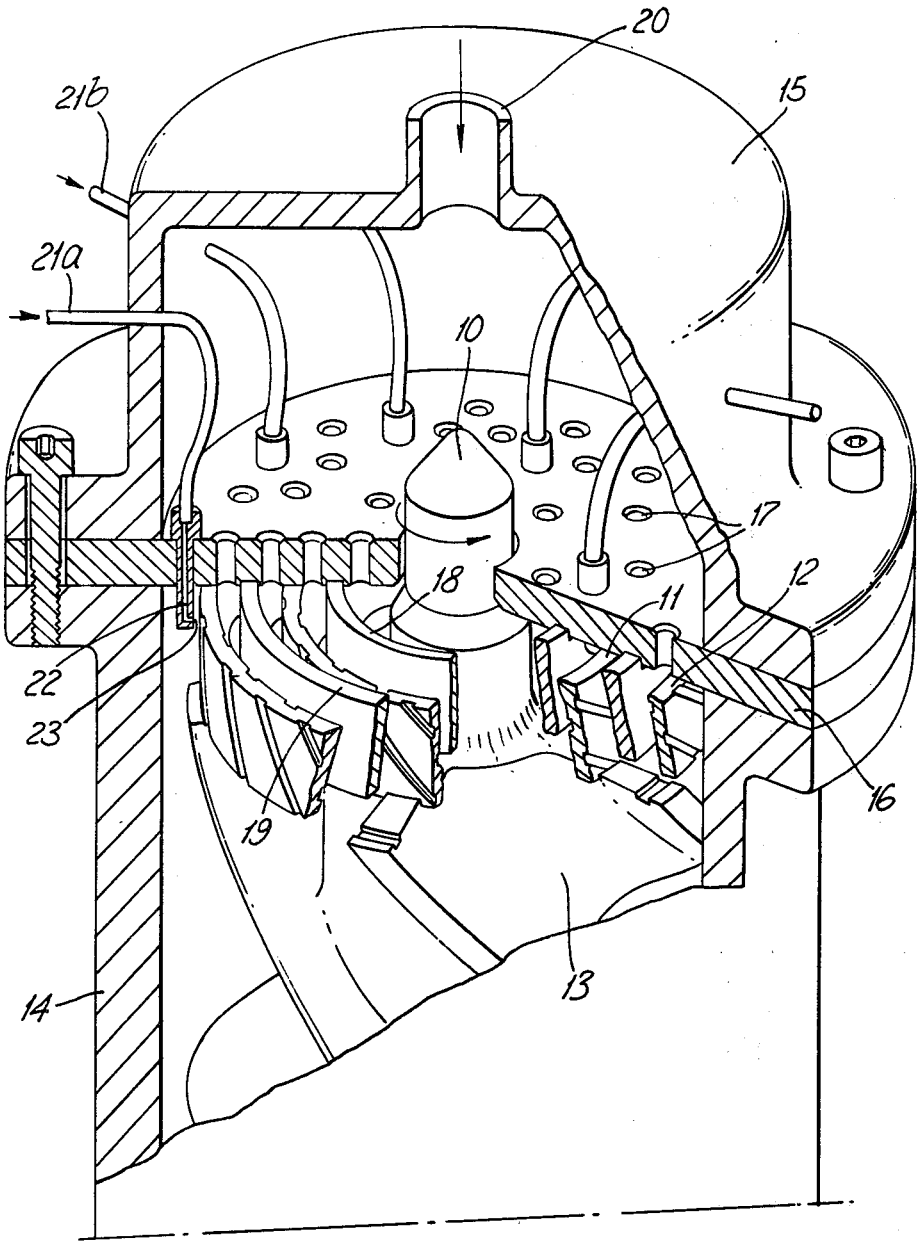
FIG. 2 shows an apparatus for mixing liquids according to the present invention with four pairs of body of revolution and surrounding co-operating casing.

Referring to FIG. 2, a rotor (10), comprising an inner body of revolution (11), an outer body of revolution (12) and a screw (13) is adapted for rotation within a housing (14) having removable end-cover (15) separated from the main body of the housing (14) by a circular plate (16) having a number of apertures (17) passing perpendicularly through it and having welded to it an inner annulus (18) and an outer annulus (19). Thus the housing 14, inner annulus 18 and outer annulus 19 constitute casings for the bodies of revolution 11 and 12. The end cover (15) is fitted with an inlet for second liquid (20) and a number of pipes (21*a*, 21*b* etc) which pass through its wall and communicate each with a jet (22) terminating in an exit (23) at a distance of 0.015 inches (0.38 mm.) from the surface of a body of revolution (11) or (12).

The inner body of revolution (11) was essentially an annulus of internal radius 1⅜ inches (34.9 mm.) and external radius 1⅝ inches (41.3 mm.) and of length 1⅛ inches (28.6 mm.), and having on each of its curved surfaces 18 spiral grooves of depth 0.1 inch (2.5 mm.) and width ⅛ inch (3.2 mm.) at an angle of 45° to the axis of rotation. The outer body of revolution (12) was essentially an annulus of internal radius 2¼ inches (57.2 mm.) and external radius 2½ inches (63.5 mm.) and of length 1⅛ inches (28.6 mm.), and having on each of its curved surfaces 30 spiral grooves of depth 0.1 inch (2.5 mm.) and width ⅛ inch at an angle of 45° to the axis of rotation. The jets (22) were in such number and so located as to provide 2 with exits (23) adjacent to each of the outer and inner curved surfaces of the inner body of revolution (11) and 3 with exits (23) adjacent to each of the outer and inner curved surfaces of the inner body of revolution (11) and 3 with exits (23) adjacent to each of the outer and inner curved surfaces of the outer body of revolution (12), the jets associated with a particular surface being equidistantly spaced from each other. Each of the bodies of revolution (11, 12) was distant from the circular plate (16) by 5/16 inches (7.9 mm.). The screw (13) comprises a cylinder of length 14.25 inches (362 mm.) and diameter 5.375 inches (136.5 mm.) in the surface of which are cut 6 substantially semi-elliptical cross section spiral channels of 0.75 inches (19 mm.) width and maximum depth 1 inch (25.4 mm.) at an angle of 55° to the axis of rotation. In addition, the screw has 5 axially disposed grooves (not shown in the Figure) in the screw flights ¾ inch (19 mm.) in width and to the full depth of the grooves.

What we claim is:

1. An apparatus for mixing a first liquid in minor amount with a second liquid in major amount, comprising: a body of revolution surrounded by a co-operating casing so as to define at least one space therebetween, the body and the casing being adapted for relative rotation, and inlet for introducing the second liquid in axial direction to said space, the cooperating surface of the body or the casing which is rotatable having in it a plurality of grooves at an angle less than 80° to its axis of rotation; an inlet for introducing the first liquid into the space at a point distant from the surface bearing the plurality of grooves by no more than 0.030 inches (0.76 mm.) and no less than 0.005 inches (0.13 mm.); and means for receiving the liquids immediately after passage between the cooperating surfaces and for applying high grade dispersive mixing to provide a fine dispersion of the first liquid in the second liquid.

2. An apparatus according to claim 1 wherein the body of revolution is cylindrical.

3. An apparatus according to claim 1 wherein the inner surface of the surrounding cooperating casing is cylindrical.

4. An apparatus according to claim 1 wherein the distance apart of the plurality of grooves is at least equal to the width of a groove and does not exceed 10 times the width of a groove.

5. An apparatus according to claim 1 wherein the distance apart of the plurality of grooves is not less than twice and not more than 5 times the width of a groove.

6. An apparatus according to claim 1 wherein each groove has a floor which is rounded.

7. An apparatus according to claim 1 wherein the distance between the body and the casing is at least a sixteenth of an inch (1.59 mm.) but does not exceed half an inch (12.7 mm.).

8. An apparatus according to claim 1 wherein the inlet for the first liquid is distant from the surface bearing the plurality of grooves by no more than 0.020 inches (0.5 mm.) and no less than 0.010 inches (0.25 mm.).

9. An apparatus according to claim 1 wherein the inlet for the first liquid is close to the end of the plurality of grooves nearer to said inlet.

10. An apparatus according to claim 1 wherein the plurality of grooves have the same spiral angle.

11. An apparatus according to claim 1 wherein the means for providing high grade dispersive mixing comprises an extension of the body of revolution adapted for cooperation with an extension of the surrounding casing the surface adapted for cooperation which is rotated being in the form of a screw forming a close fit with the surface of the extension adapted for cooperation.

12. A process for the mixing of a first liquid in minor amount with a second liquid in major amount comprising continuously forcibly feeding the second liquid in an axial direction through at least one space delineated by a body of revolution and a surrounding cooperating casing, imparting relative rotation between the body and the casing, the cooperating surface of the body or of the casing which is rotated having in it a plurality of grooves at an angle less than 80° to its axis of rotation, the first liquid being continuously forcibly fed into the space at a point distant from the surface bearing the plurality of grooves by no more than 0.030 inches (0.76 mm.) and no less than 0.005 inches (0.13 mm.); and immediately thereafter feeding the two liquids through a zone and effecting high grade dispersive mixing therein whereby fine dispersion of the first liquid in the second liquid is completed.

13. A process according to claim 12 wherein the liquid in major amount has at least ten times the viscosity of that of the liquid in minor amount.

14. A process according to claim 12 wherein the liquid in major amount has at least 1,000 times the viscosity of that of the liquid in minor amount.

15. A process according to claim 12 wherein the body of revolution is cylindrical.

16. A process according to claim 12 wherein the inner surface of the surrounding cooperating casing is cylindrical.

17. A process according to claim 12 wherein the distance apart of the plurality of grooves is at least equal to the width of a groove and does not exceed 10 times the width of a groove.

18. A process according to claim 12 wherein the distance apart of the plurality of grooves is not less than twice and not more than 5 times the width of a groove.

19. A process according to claim 12 wherein the floor of each groove is rounded.

20. A process according to claim 12 wherein the distance between the body and the casing is at least a sixteenth of an inch (1.59 mm.) but does not exceed half an inch (12.7 mm.).

21. A process according to claim 12 wherein the point at which the first liquid is fed into the chamber is distant from the surface bearing the plurality of grooves by no more than 0.020 inches (0.5 mm.) and no less than 0.010 inches (0.25 mm.).

22. A process according to claim 12 wherein the point at which the first liquid is fed into the chamber is just downstream of the end of the plurality of grooves nearer to the inlet.

23. A process according to claim 12 wherein the plurality of grooves have the same spiral angle.

24. A process according to claim 12 wherein the plurality of grooves spiral in such sense with respect to the sense of rotation that they tend to impose on the liquids a flow opposed to that of the forcible feed of the second liquid.

25. A process according to claim 12 wherein the zone wherein high grade dispersive mixing is effected comprises an extension of the body of revolution cooperating with an extension of the surrounding casing, the cooperating surface which is rotated being in the form of a screw forming a close fit with the cooperating extension.

* * * * *